US005099919A

United States Patent [19]

Schneider et al.

[11] Patent Number: 5,099,919

[45] Date of Patent: Mar. 31, 1992

[54] PLUG FOR WELL LOGGING OPERATIONS

[76] Inventors: John L. Schneider, Beech Wood Place, West Hill, Skene, Aberdeenshire; Hugo M. Barcia, 18 Brimmond Drive, West Hill, Aberdeen AB3 6SF, both of United Kingdom

[21] Appl. No.: 634,877

[22] PCT Filed: Jul. 13, 1989

[86] PCT No.: PCT/GB89/00799

§ 371 Date: Jan. 9, 1991

§ 102(e) Date: Jan. 9, 1991

[87] PCT Pub. No.: WO90/00667

PCT Pub. Date: Jan. 25, 1990

[30] Foreign Application Priority Data

Jul. 14, 1988 [GB] United Kingdom ..... 8816736.6

[51] Int. Cl.[5] ..... E21B 33/12; E21B 34/14

[52] U.S. Cl. ..... 166/188; 166/192; 166/324; 166/332; 166/385

[58] Field of Search ..... 166/324, 385, 188, 194, 166/332, 115, 334, 72, 70, 192, 386, 387

[56] References Cited

U.S. PATENT DOCUMENTS

| | | | |
|---|---|---|---|
| 2,745,497 | 5/1956 | Dale et al. | 166/332 |
| 2,888,080 | 5/1959 | Tausch et al. | 166/188 |
| 3,141,506 | 7/1964 | Thomas | 166/332 |
| 3,180,420 | 4/1965 | Manson, Jr. et al. | 166/133 |
| 3,454,089 | 7/1969 | Brown | 166/332 X |
| 3,791,445 | 2/1974 | True | 166/72 |
| 4,307,783 | 12/1981 | Lanmon, II | 166/379 |
| 4,392,377 | 7/1983 | Rankin | 73/155 |
| 4,729,429 | 3/1988 | Wittrisch | 166/332 X |
| 4,804,042 | 2/1989 | Knight et al. | 166/324 |

*Primary Examiner*—Hoang C. Dang

*Attorney, Agent, or Firm*—Florence U. Reynolds

[57] ABSTRACT

A logging plug for suspension on a wireline comprises a hollow body provided with packers for sealing it to a nipple included in a tubing string, and a flow tube through which the line may slide with minimal leakage. A sliding equalizing tube in the lower position shown blocks communication across the packers. When moved upwards by striking it with a hammer or logging tool, communication is allowed via ports in the equalizing tube and in the hollow body, the annular passage around the wireline and an axial bore in the lower part of the hollow body. Any pressure differential across the packers is thus equalized, allowing the logging plug to be easily withdrawn.

20 Claims, 4 Drawing Sheets

18
20
P1
P1
32
24
P1
26
30
P2
P1
34
22
28
10
P2
36
16
16
12
14
14

18
20
P1
P1
32
24
P2
26
30
P3
22
34
28
10
12
36
12
P3
14
14

18
20
34
P1
38
24
32
26
30
38
36
22
P3
28
10
12
14
14

PLUG FOR WELL LOGGING OPERATIONS

BACKGROUND OF THE INVENTION

This invention relates to logging plugs for use in oil, gas and other wells.

To ascertain parameters of well operations such as pressure, temperature and flow rate one or more logging tools are run down the well on a logging or slick line cable, which will subsequently be referred to by the further alternative term wireline. As many of these parameters must be measured while the pressure in the perforation zone is different from that obtaining in the upper part of the well down which the logging tool is run, it is necessary for the wireline to be passed through a logging plug which maintains a good, but not perfect seal, with the wire, and which is itself sealable within a nipple incorporated in production tubing, by-pass tubing or the well casing.

Considerations arising from a typical employment of a conventional logging plug will now be discussed with reference to the accompanying diagrammatic drawings in which:

BRIEF DESCRIPTION OF THE DRAWINGS

As shown in FIG. 1 a well casing 10 has a perforated zone 12 through which oil flows from a reservoir 14 as indicated by the arrows 16. From the bottom of a production string 18 is suspended a Y-crossover tool 20 from which depends an electric submersible pump 22 with the interposition of a pump sub 24 containing a non-return valve 26. From the tool 20 there also depends a length of by-pass tubing 28 formed with a nipple 30 in which a conventional logging plug 32 is sealed; slidably passing through the plug 32 but in effective sealing engagement therewith is a wireline 34 from which a logging tool 36 for measuring well parameters is suspended.

In FIG. 1 the pressure obtaining within the well casing is denoted $P_2$ and the pressure on the outlet side of the pump 22 which is higher than $P_2$, as $P_1$. There is thus a differential pressure $P_1-P_2$, defined as $\Delta P_1$, acting downwardly on the logging plug 32. As this differential pressure holds the plug firmly in place, it must be substantially eliminated to allow the logging plug to be removed, and the tools withdrawn. However, equalization of pressure cannot be achieved simply by switching off the pump 22 due to the action of the non-return valve 26, as will now be explained with reference to FIG. 2.

When the pump 22 is switched off the pressure below the check valve 26 will increase until it equals the static reservoir pressure $P_3$. $P_3$ is greater than running pump intake (flowing well bore) pressure $P_2$ but less than pump discharge pressure $P_1$ which still obtains above check valve 26. The pressure differential holding the plug 32 in place will now be $P_1-P_3$, defined as $\Delta P_2$, and the force exerted on the plug 32 will be $\Delta P_2 \times$(cross-sectional area of plug 32).

Figure 3:
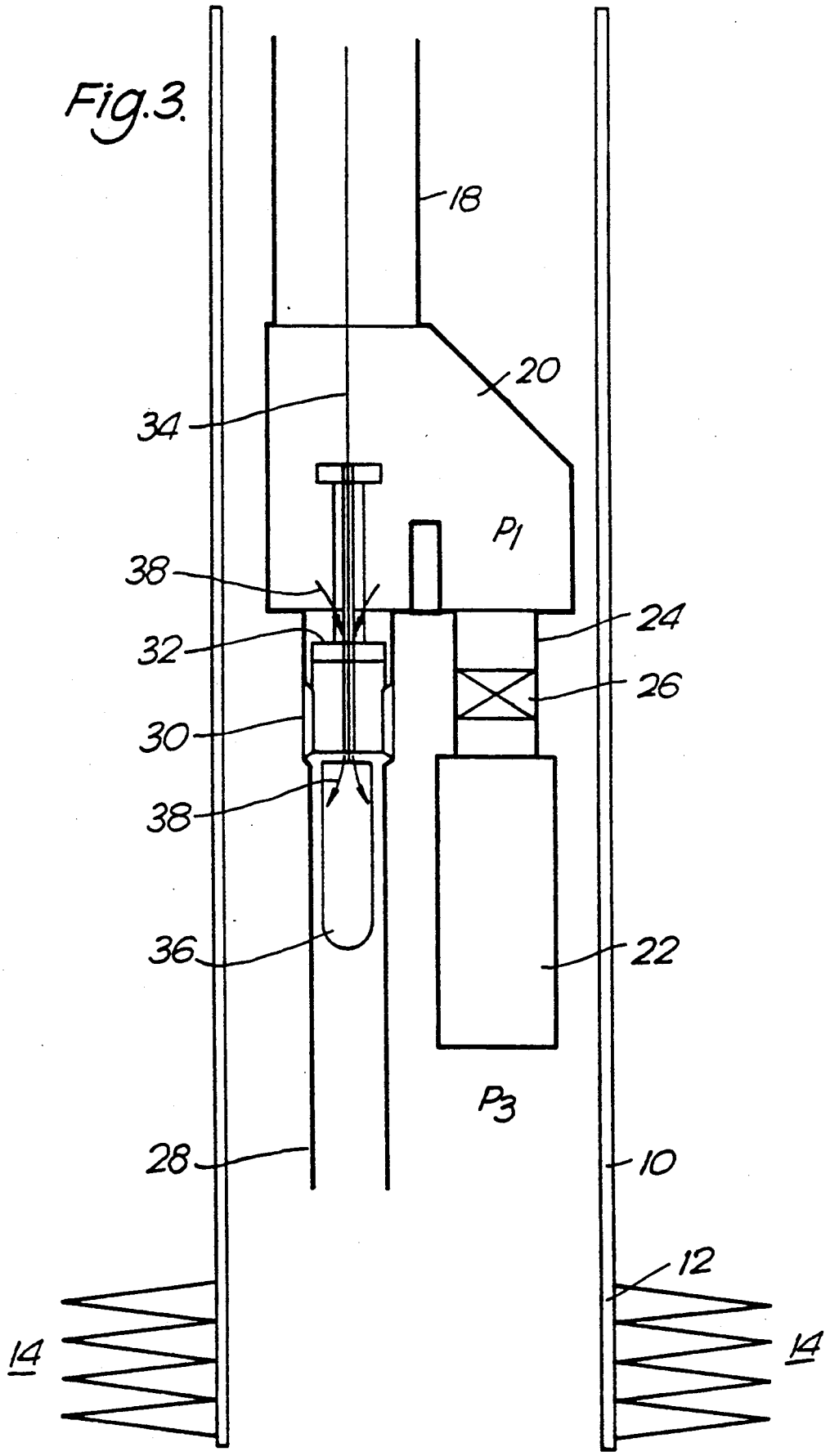
FIG. 3 corresponds to FIGS. 1 and 2 illustrates a stage in the removal of the logging plug.

In current practice the pressure differential is equalized simply by relying on leakage past the wireline 34, as indicated by the arrows 38 in FIG. 3, where there is not, as previously mentioned, a perfect seal. However, it can take considerable time for such equalization to occur, and $P_1$ to equal $P_3$, thus allowing the logging plug 32 to be withdrawn, withdrawal being effected by abutment with the tool 36 as shown in FIG. 3.

Figure 4:
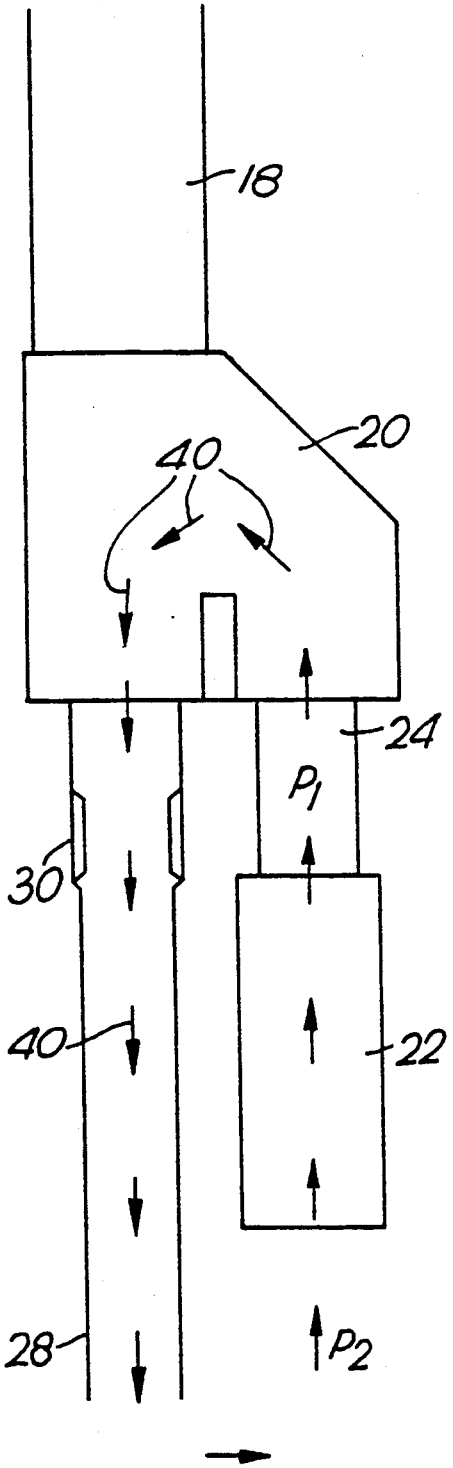
FIG. 4 is a detail illustrating circulation in the absence of a logging plug.

FIG. 4 illustrates the situation if it were attempted to run a logging tool through a by-pass system without isolation. As before the intake pressure of pump 22 is designated $P_2$ and the discharge pressure $P_1$, the pressure differential $P_1-P_2$ being defined as $\Delta P$. The existence of this differential tends to cause re-circulation of pumped fluid around the by-pass system in the direction of the arrows 40.

A logging plug may be used in other situations in which it is required to suspend a logging tool on a wireline passing through a point of pressure differential, for example in a standard well completion without an ESP being present in the well.

SUMMARY OF THE INVENTION

It is an aim of the present invention to provide a logging plug which allows the pressures obtaining above and below the plug to rapidly equalize and thus allow withdrawal of the plug and logging tools.

According to the present invention there is provided a logging plug for suspension on a wireline comprising a hollow body provided with sealing means by which it may be sealed within a nipple included in a tubing string, the body also providing or receiving means to allow a wireline to be passed therethrough while maintaining a substantial seal, and an equalizing member through which the wireline may freely pass and which is arranged for sliding movement within said body between a first position in which communication past said sealing means is prevented and a second position in which communication past the sealing means is allowed.

Preferably the equalizing member has at least one port communicating with an axial bore through which the wireline passes and which in the first position is closed by a sleeve forming part of the hollow body, and in the second position communicates with one or more ports formed through the wall of the hollow body.

Preferably again, the equalizing member is located at the lower end of the logging plug so that it may be displaced from the first to the second position by the upward impact of a logging hammer or of a logging tool attached to the wireline.

DETAILED DESCRIPTION

An embodiment of the invention will now be described, by way of example, with reference to FIG. 5 of the accompanying drawings which is an axial section through an equalizing logging plug according to the invention.

Figure 1:
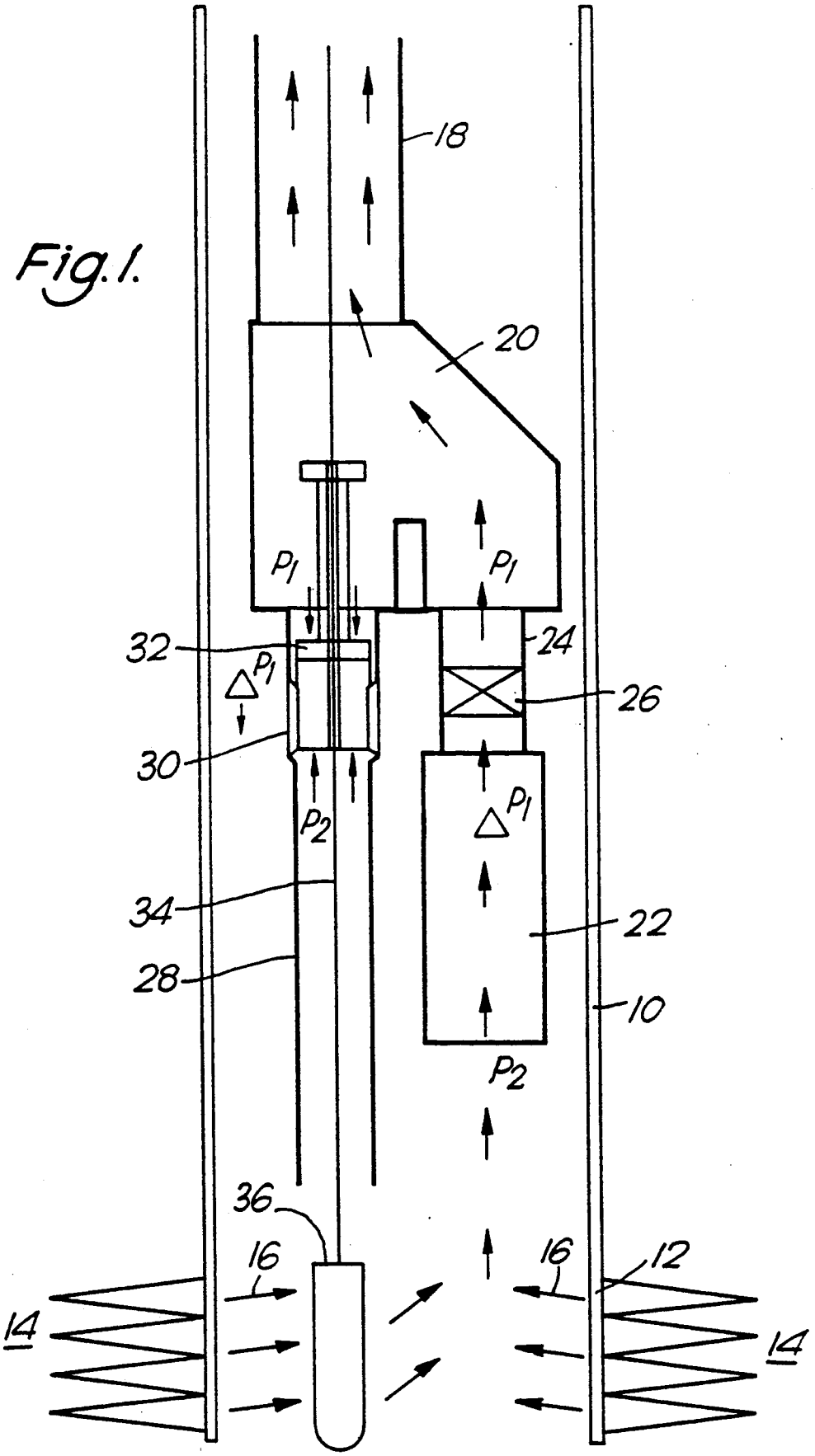
FIG. 1 is a vertical section through a length of an oil well including a perforated zone, and a logging plug, electric submersible pump (ESP) and by-pass system installed therein with the pump running.
Figure 2:
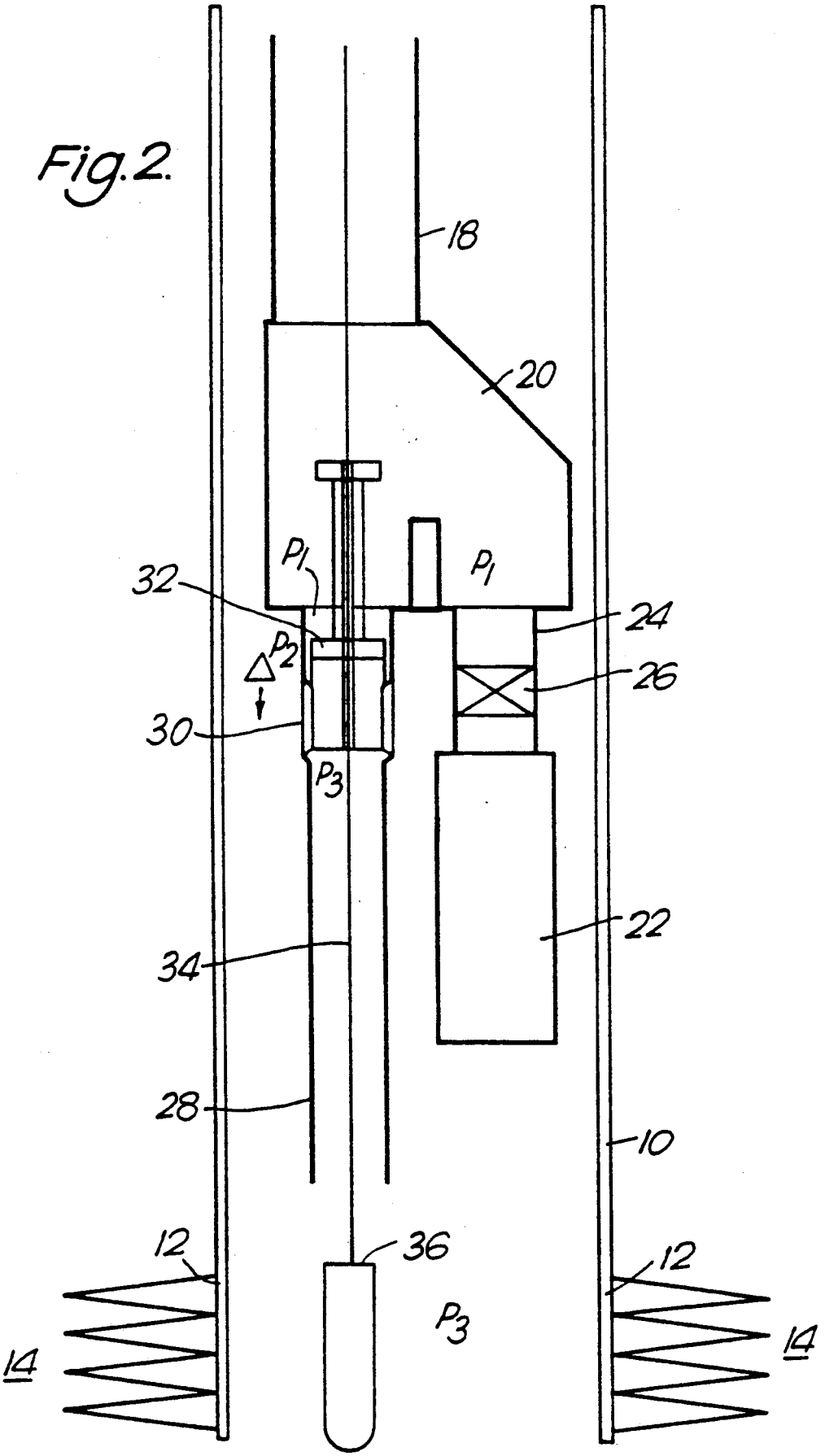
FIG. 2 corresponds to FIG. 1 and shows pressures obtaining after the pump has been switched off.
Figure 5:
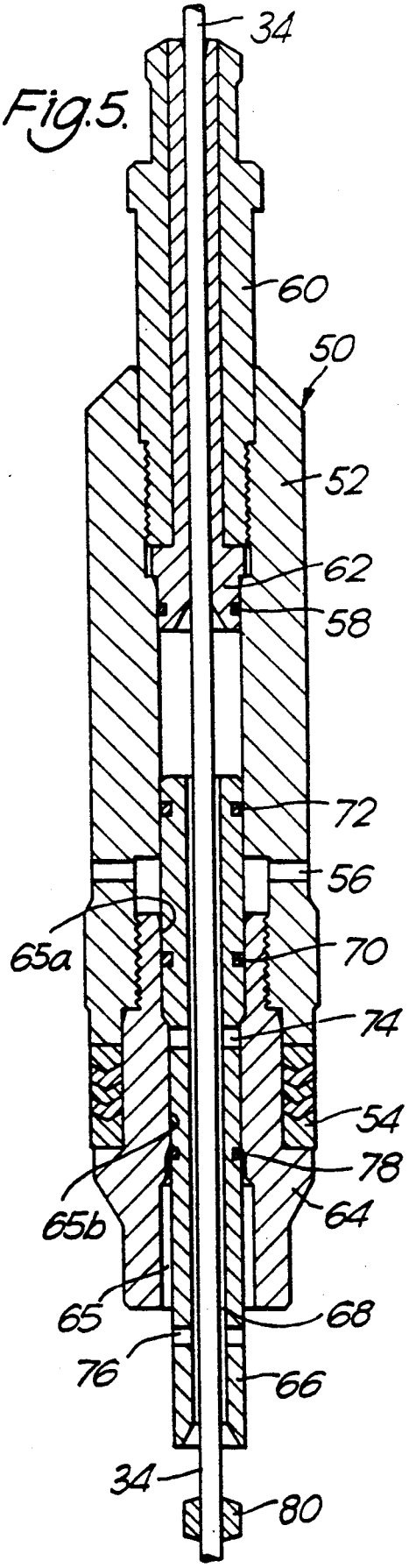
FIG. 5 is an enlarged longitudinal cross-sectional view of the logging plug.

The equalizing logging plug 50 shown in FIG. 5 surrounds the wireline 34 and comprises a hollow body 52 fitted at its lower end with seals 54 by which it may be seated in a nipple, for example the nipple 30 of FIG. 1. Ports 56 are formed in the wall of the body 52 above the packers 54.

Sealed within the upper part of the body 52 by an O-ring 58 and retained by a collar 60 is a flow tube 62 having an internal diameter such that the wireline 34 may pass freely therethrough in the presence or absence of a pressure differential without causing substantial friction or wear, but on the other hand allowing very little fluid flow around the wireline 34.

Forming the lower part of the body 52 is an insert 64 having an axial bore 65, the upper portion 65*a* and the reduced diameter medial portion 65*b* of which receive in a close sliding fit lengths of an equalizing tube 66 which itself has an axial bore of a diameter such as to define with the wireline 34 passing there-through an annular passage 68. The tube 66 is sealed within the bore portion 65*a* by O-ring 70, and within the bore through the body 52 in which its upper part is a sliding fit by O-ring 72. Lateral communication through the wall of the tube 66 with the annular passage 68 is provided by upper ports 74 and lower ports 76. A snap ring 78 is recessed into the equalizing tube 66 in a position which in the FIG. 5 condition is just below the bore portion 65*b*.

A logging hammer 80 may be secured to the wireline 34 above or below the plug 50 to assist in either seating the logging plug in the nipple or removing it from the nipple.

If the plug 50 is substituted, in the by-pass system operating shown in FIG. 1, for the plug 32, well fluid discharged from the pump 22 will similarly be pumped through the Y-crossover tool 20 and production string 18, but a negligible quantity will flow between the flow tube 62 and wireline 34 and through the annular passage 68 to be recirculated through the pump 22; a seal with the wireline 34 is thus established in the by-pass tubing 28 while still allowing passage of the wireline 34.

When the plug 50 is in the closed condition shown in FIG. 5 there is no communication from the ports 56 through the body 52 down past the packers 54 to the bottom of plug 50: as will be seen the O-ring 70 blocks communication through the bore 65, and the O-ring 72 through the bore in the body 52, blocking leakage into the annular passage 68 round the top of the tube 66. The plug 50 thus effectively seals across the nipple 30.

As explained in connection with FIG. 3 the plug is still subjected to a considerable downward force ($\Delta P_2 \times$ cross-sectional area) after the pump 22 has been switched off. It is usually operationally impossible to pull the logging plug 32 out of the nipple 30 by applying a upward force greater than this downward force, and it is therefore necessary to equalize the pressure differential from above to below the plug. Such equalization is readily achieved with the plug 50.

It will be noted that by virtue of the annular passage 68 the pressure on the tube 66 is the same at all points. No pressure differential therefore has to be overcome in displacing the tube 66 upwards, which can easily be achieved by pulling on the wireline 34 and striking the bottom of the tube 66 with logging hammer 80 or the logging tool. The consequent upward displacement of the tube 66 to a position in which the ports 74 are in register with the ports 56 establishes fluid communication from above the seals 54, through the ports 56 and 74 and the annular passage 68, and out into the by-pass tubing 28 below the packers 54 via both the lower ports 76 and the open end of the annular passage 68. The upward displacement of the tube 66 compresses the snap ring 78 as it passes through the bore portion 65*b*; after the ring 78 passes the shoulder at the top of bore portion 65*b* it expands to maintain the tube 66 in its upper, open position.

After fluid flow through the lower part of the plug 50 along the above-described route has achieved equalization of the pressures above and below the packers 54, the plug 50 may easily be withdrawn from the nipple 30 and the well.

Instead of the snap ring 78 a similar retaining device such as a shear pin may be used.

We claim:

1. A logging plug comprising a hollow body having a lower end and an upper end; sealing means for sealing the hollow body within a nipple included in a tubing string; means for allowing a logging tool suspension means to be passed through the body while maintaining a substantial seal to the suspension means; and an equalizing member through which the suspension means may freely pass and which is arranged for sliding movement within said body between a first position in which fluid communication from above said body past said sealing means to below said body is prevented and a second position in which such communication past the sealing means is allowed.

2. The logging plug as claimed in claim 1, in which the equalizing member has at least one port communicating with an axial bore through which the suspension means passes and which in the first position is closed by a sleeve forming part of the hollow body and in the second position communicates with one or more ports formed through the wall of the hollow body.

3. The logging plug as claimed in claim 2, in which the equalizing member has at least one further port communicating with said axial bore at the end thereof remote from said one port and which in said first position is outside the hollow body and in said second position communicates with an annular space defined by the equalizing member and the outer end of said sleeve.

4. The logging plug as claimed in claim 1, further comprising retaining means to maintain the equalizing member in said second position.

5. The logging plug as claimed in claim 2, further comprising retaining means to maintain the equalizing member in said second position.

6. The logging plug as claimed in claim 3, further comprising retaining means to maintain the equalizing member in said second position.

7. The logging plug as claimed in claim 1 attached to the logging tool suspension means having a logging tool suspended below the plug, wherein the equalizing member is located at the lower end of the logging plug so that the equalizing member may be displaced from the first to the second position by upward impact of the logging tool.

8. The logging plug as claimed in claim 7, wherein a logging hammer is attached to the suspension means between the plug and the logging tool so that the equalizing member may be displaced from the first to the second position by upward impact of the logging hammer.

9. The logging plug as claimed in claim 2 attached to the logging tool suspension means having a logging tool suspended below the plug, wherein the equalizing member is located at the lower end of the logging plug so that the equalizing member may be displaced from the first to the second position by upward impact of the logging tool.

10. The logging plug as claimed in claim 9, wherein a logging hammer is attached to the suspension means between the plug and the logging tool so that the equalizing member may be displaced from the first to the second position by upward impact of the logging hammer.

11. The logging plug as claimed in claim 3 attached to the logging tool suspension means having a logging tool suspended below the plug, wherein the equalizing member is located at the lower end of the logging plug so that the equalizing member may be displaced from the first to the second position by upward impact of the logging tool.

12. The logging plug as claimed in claim 11, wherein a logging hammer is attached to the suspension means between the plug and the logging tool so that the equalizing member may be displaced from the first to the second position by upward impact of the logging hammer.

13. The logging plug as claimed in claim 4 attached to the logging tool suspension means having a logging tool suspended below the plug, wherein the equalizing member is located at the lower end of the logging plug so that the equalizing member may be displaced from the first to the second position by upward impact of the logging tool.

14. The logging plug as claimed in claim 13, wherein a logging hammer is attached to the suspension means between the plug and the logging tool so that the equalizing member may be displaced from the first to the second position by upward impact of the logging hammer.

15. The logging plug as claimed in claim 5 attached to the logging tool suspension means having a logging tool suspended below the plug, wherein the equalizing member is located at the lower end of the logging plug so that the equalizing member may be displaced from the first to the second position by upward impact of the logging tool.

16. The logging plug as claimed in claim 15, wherein a logging hammer is attached to the suspension means between the plug and the logging tool so that the equalizing member may be displaced from the first to the second position by upward impact of the logging hammer.

17. The logging plug as claimed in claim 6 attached to the logging tool suspension means having a logging tool suspended below the plug, wherein the equalizing member is located at the lower end of the logging plug so that the equalizing member may be displaced from the first to the second position by upward impact of the logging tool.

18. The logging plug as claimed in claim 17, wherein a logging hammer is attached to the suspension means between the plug and the logging tool so that the equalizing member may be displaced from the first to the second position by upward impact of the logging hammer.

19. The logging plug as claimed in claim 1, attached to the logging tool suspension means having a logging tool suspended below the plug and a logging hammer attached to the suspension means above the plug.

20. The logging plug as claimed in claim 6, attached to the logging tool suspension means having a logging tool suspended below the plug and a logging hammer attached to the suspension means above the plug.

* * * * *